US008290389B2

(12) United States Patent
Furubayashi et al.

(10) Patent No.: US 8,290,389 B2
(45) Date of Patent: Oct. 16, 2012

(54) IMAGE FORMING APPARATUS AND CONTACT-CORROSION PREVENTION METHOD PERFORMED BY SAME

(75) Inventors: Toshiya Furubayashi, Takarazuka (JP); Yasuhiro Ishihara, Toyohashi (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 263 days.

(21) Appl. No.: 12/881,629

(22) Filed: Sep. 14, 2010

(65) Prior Publication Data

US 2011/0064423 A1 Mar. 17, 2011

(30) Foreign Application Priority Data

Sep. 17, 2009 (JP) ..... 2009-216164

(51) Int. Cl.
*G03G 15/00* (2006.01)
*G03G 21/16* (2006.01)

(52) U.S. Cl. ..... 399/90; 399/12; 399/111

(58) Field of Classification Search ..... 399/90, 399/12, 13, 111
See application file for complete search history.

(56) References Cited

U.S. PATENT DOCUMENTS

| | | | |
|---|---|---|---|
| 7,550,878 | B2 | 6/2009 | Komatsu et al. |
| 7,664,408 | B2 * | 2/2010 | Watanabe et al. |
| 2008/0316533 | A1 | 12/2008 | Kawai |

FOREIGN PATENT DOCUMENTS

| | | | |
|---|---|---|---|
| JP | 2005-294200 | A | 10/2005 |
| JP | 2006-091387 | | 4/2006 |
| JP | 2007-26992 | A | 2/2007 |
| JP | 2009-003294 | | 1/2009 |

OTHER PUBLICATIONS

Office Action (Preliminary Notice of Rejection) dated Aug. 30, 2011, issued in the corresponding Japanese Patent Application No. 2009-216164, and an English Translation thereof.

* cited by examiner

*Primary Examiner* — Susan Lee
(74) *Attorney, Agent, or Firm* — Buchanan Ingersoll & Rooney PC

(57) ABSTRACT

A main body of an image forming apparatus includes a switching circuit provided for switching between a normal current which should be applied at a time of normal operation and a contact-corrosion preventing current which is set larger than the normal current. Each of the currents is to be applied to an imaging unit through the contacts between the main body and the imaging unit. A control section controls the switching circuit so as to temporarily switch from the normal current to the contact-corrosion preventing current at specified timing.

12 Claims, 10 Drawing Sheets

IMAGE FORMING APPARATUS AND CONTACT-CORROSION PREVENTION METHOD PERFORMED BY SAME

This application is based on an application No. 2009-216164 filed in Japan, the entire content of which is hereby incorporated by reference.

TECHNICAL FIELD

The present invention relates to an image forming apparatus, and more specifically relates to an image forming apparatus, such as copying machines and printers, composed of a main body and an imaging unit (also referred to as a process cartridge) including a photoconductor drum and a developing device necessary to perform electrophotographic process, the imaging unit being detachably mounted on the main body. The present invention also relates to a contact-corrosion prevention method performed by such an image forming apparatus.

BACKGROUND ART

In this kind of an image forming apparatus including an imaging unit detachably mounted on the main body of the image forming apparatus, tin plating may be applied, in place of gold plating, to contacts for electrically connecting a communication line between the main body and the imaging unit from a viewpoint of cost reduction.

However, when tin-plated contacts are used, a naturally oxidized film (corrosion) is generated on the surface of the contacts depending on contact force, contact frequency, and environmental conditions such as temperature and humidity, which may lead to degraded reliability.

Accordingly, a switch-contact corrosion removal device has been proposed for example in JP 2007-26992 A, in which upon speculation or detection of corrosion generated on a switch, a corrosion removal current larger than a normal current is applied to remove the corrosion generated at the contacts of the switch. In JP 2005-294200 A, contact-corrosion prevention circuit has been proposed in which as contacts corrode and a contact resistance is increased thereby, an increase of an input signal line potential in a closed state of the contacts is detected so that the contacts are heated with use of a current from a supply voltage side to remove the corrosion.

SUMMARY OF INVENTION

Technical Problem

However, the techniques of JP 2007-26992 A and JP 2005-294200 A do not take it into consideration that the imaging unit is detachably mounted on the main body of the image forming apparatus.

Solution to Problem

Accordingly, an object of the invention is to provide a type of an image forming apparatus having an imaging unit detachably mounted on a main body, which can enhance the reliability of electric connection between the main body and the imaging unit. Another object of the invention is to provide a contact-corrosion prevention method performed by such an image forming apparatus.

In order to accomplish the object, an image forming apparatus according to the present invention comprises:

a main body; and at least one imaging unit detachably mounted on the main body for performing electrophotographic process, wherein when the imaging unit is mounted on the main body, the main body and the imaging unit are electrically connected via contacts of each other, and wherein the main body comprises:

a switching circuit for switching between a normal current which should be applied at a time of normal operation and a contact-corrosion preventing current which is set larger than the normal current, each of the currents being to be applied to the imaging unit through the contacts; and a control section for controlling the switching circuit to temporarily switch from the normal current to the contact-corrosion preventing current at specified timing.

In this specification, the term "contact-corrosion prevention" refers to destroying a natural oxidation film generated on the surface of the contacts before actual harm is inflicted upon passing of current.

In this specification, the term "door" refers to the door used for attachment and detachment (for replacement and the like) of imaging units.

In this specification, the term "genuine part" refers to components formally specified by the production and distribution companies (product manufacturers) of image forming apparatuses as optional parts, replacement parts or repair parts for the pertinent products. It should be understood that if an imaging unit mounted on the main body of the image forming apparatus is a genuine part; the imaging unit shall withstand the contact-corrosion preventing current.

In another aspect, a contact-corrosion prevention method performed by an image forming apparatus according to the present invention, comprises:

a step for electrically connecting a main body and an imaging unit via contacts of each other when the imaging unit for performing electrophotographic process is detachably mounted on the main body;

a step for applying a normal current to the imaging unit through the contacts at a time of normal operation;

a step for controlling a switching circuit so as to temporarily switch from the normal current to a contact-corrosion preventing current set larger than the normal current at predetermined timing; and a step for applying the contact-corrosion preventing current to the imaging unit when the switching circuit is switched.

BRIEF DESCRIPTION OF DRAWINGS

The present invention will become more fully understood from the detailed description given hereinbelow and the accompanying drawings which are given by way of illustration only, and thus are not limitative of the present invention, and wherein.

DESCRIPTION OF EMBODIMENTS

Hereinbelow, the invention will be described in detail in conjunction with the embodiments with reference to the drawings.

Figure 1:
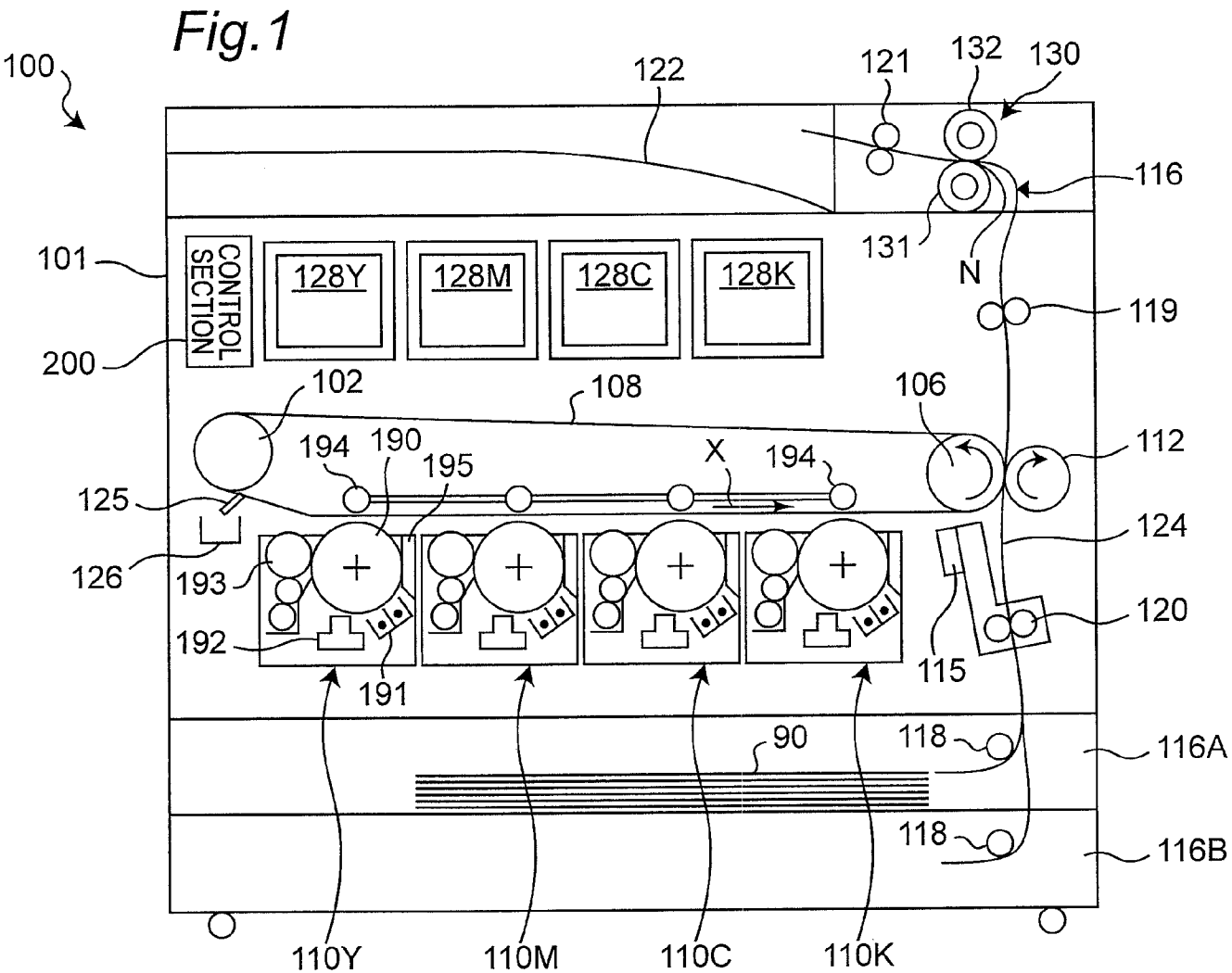
FIG. 1 is a cross sectional view schematically showing an entire configuration of an image forming apparatus in one embodiment of the invention.

FIG. 1 shows a cross sectional structure of a color tandem-type image forming apparatus 100 in one embodiment of the invention. The image forming apparatus 100 includes an intermediate transfer belt 108 as an annular image carrier provided generally in the center inside a main body casing 101, the intermediate transfer belt 108 being wound around two rollers 102 and 106 and moving in the circumferential direction. One roller 102 out of two rollers 102 and 106 is placed on the left-hand side in the drawing, while the other roller 106 is placed on the right-hand side in the drawing. The intermediate transfer belt 108 is supported on these rollers 102 and 106, and is rotated in an arrow X direction.

Toner containers 128Y, 128M, 128C and 128K for storing respective color toners of yellow (Y), magenta (M), cyan (C) and black (K) are placed side by side in order from the left-hand side in the drawing above the intermediate transfer belt 108. These toners are respectively fed from the toner containers 128Y, 128M, 128C and 128K to later-described developing devices 193 of imaging units of corresponding colors 110Y, 110M, 110C and 110K.

The imaging units 110Y, 110M, 110C and 110K as image forming sections corresponding to respective color toners of yellow (Y), magenta (M), cyan (C) and black (K) are placed side by side in order from the left-hand side in the drawing below the intermediate transfer belt 108. These imaging units 110Y, 110M, 110C and 110K are detachably mounted on the main body of the image forming apparatus 100. An unshown door used for attachment and detachment of these imaging units 110Y, 110M, 110C and 110K is provided on the main body casing 101.

The respective imaging units 110Y, 110M, 110C and 110K have completely similar configuration except for a difference in toner color that the respective units handle. More specifically, the yellow imaging unit 110Y for example is integrally composed of a photoconductor drum 190, a charging device 191, an exposure device 192, a developing device 193 for development with use of toner, and a cleaning device 195. A primary transfer roller 194 is provided in a position facing the photoconductor drum 190 across the intermediate transfer belt 108. At the time of image formation, the surface of the photoconductor drum 190 is first uniformly charged by the charging device 191, and then the surface of the photoconductor drum 190 is exposed by the exposure device 192 in response to an image signal inputted from, for example, an unshown external device to form a latent image thereon. Next, the latent image on the surface of the photoconductor drum 190 is developed into a toner image by the developing device 193. The toner image is transferred onto the intermediate transfer belt 108 upon voltage application between the photoconductor drum 190 and the primary transfer roller 194. Transfer residual toner on the surface of the photoconductor drum 190 is cleaned by the cleaning device 195.

As the intermediate transfer belt 108 moves in the arrow X direction, overlapped toner images of four colors are formed on the intermediate transfer belt 108 by each of the imaging units 110Y, 110M, 110C and 110K.

Provided on the left-hand side of the intermediate transfer belt 108 are a cleaning device 125 for removing residual toner from the surface of the intermediate transfer belt 108 and a toner collecting box 126 for collecting the toner removed by the cleaning device 125. A secondary transfer roller 112 is provided on the right-hand side of the intermediate transfer belt 108 across a conveying path 124 for paper sheets. Conveying rollers 120 and 119 are provided respectively at positions corresponding to upstream and downstream sides of the secondary transfer roller 112 on the conveying path 124. It is to be noted that a photo sensor (toner concentration sensor) 115 for detecting a toner pattern on the intermediate transfer belt 108 is provided integrally with the conveying roller 120.

A fixing device 130 for fixing toner onto paper sheets is provided on the upper right part inside the main body casing 101. The fixing device 130 includes a paper feed sensor 116 as a paper sensor for detecting paper sheets as the sheets conveyed into the fixing device 130, a heating roller 131 extending vertically with respect to the page of FIG. 1, and a pressure roller 132 as a pressure applying member also extending vertically with respect to the page of FIG. 1 and being in pressure contact with the heating roller 131. In this example, the heating roller 131, incorporates an unshown heating source. The pressure roller 132 is biased toward the heating roller 131 with an unshown spring. Accordingly, the heating roller 131 and the pressure roller 132 form a nip area N for fixation. As a paper sheet 90 carrying a toner image transferred thereon passes through the nip area N, the toner image is fixed onto the paper sheet 90. It is to be noted that the paper feed sensor 116 is provided upstream from the nip area N with respect to the conveying direction of the paper sheet 90. The fixing device 130 operates based on the timing of the paper feed sensor 116 detecting the paper sheet 90.

Paper cassettes 116A and 116B for storing paper sheets 90 as the sheets on which images are to be formed are provided in two levels in the lower part of the main body casing 101 (for simplification, the drawing shows the state that the paper sheets 90 are stored only in the paper cassette 116A).

When the image forming apparatus 100 receives a print job from, for example, the outside, a control section 200 constituted of a CPU (Central Processing Unit) controls the entire image forming apparatus 100 to execute image forming operation according to the print job.

At the time of image formation, paper sheets 90 are sent out by a feed roller 118 one by one from the paper cassette 116A to the conveying path 124, and are conveyed to a toner transfer position between the intermediate transfer belt 108 and the secondary transfer roller 112 by the conveying roller 120. Meanwhile, an overlapped toner image of four colors is formed on the intermediate transfer belt 108 by each of the imaging units 110Y, 110M, 110C and 110K as mentioned before. The toner image of four colors on the intermediate transfer belt 108 is transferred onto a paper sheet 90, which was sent into the above-mentioned toner transfer position, by the secondary transfer roller 112. The paper sheet 90 with the toner image transferred thereon receives heat and pressure while being conveyed through the nip area N formed between the heating roller 131 and the pressure roller 132 of the fixing unit 130. As a result, the toner image is fixed onto the paper sheet 90. The paper sheet 90 with the toner image fixed thereto is then discharged by a paper ejecting roller 121 into a paper ejection tray section 122 provided on the upper surface of the main body casing 101.

Figure 2:
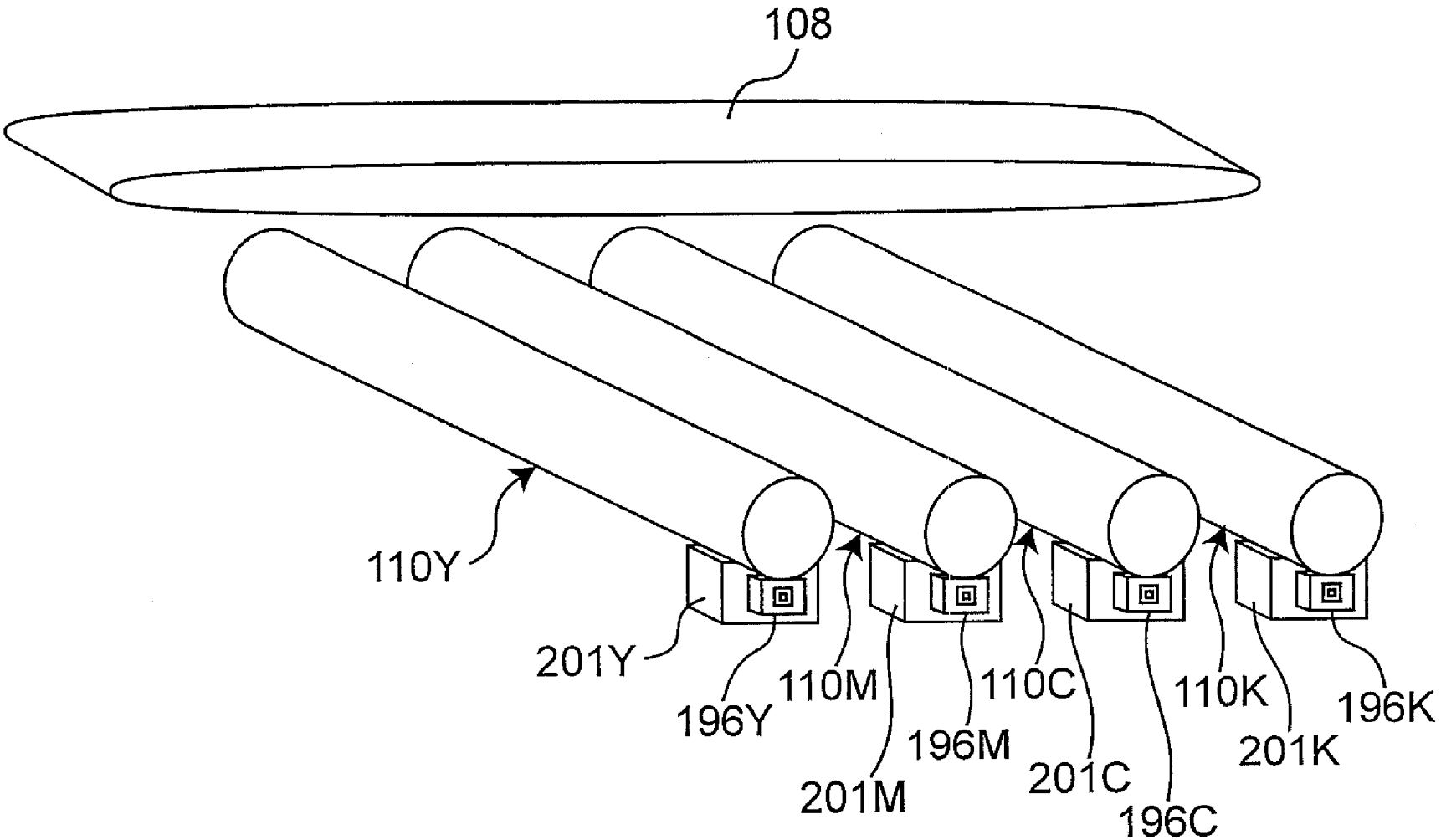
FIG. 2 is a perspective view showing an intermediate transfer belt and an imaging unit of the image forming apparatus in an exploded state.

FIG. 2 schematically shows the intermediate transfer belt 108 and the imaging units 110Y, 110M, 110C and 110K in the exploded state. Connector portions 196Y, 196M, 196C and 196K for establishing electric connection with the main body side are respectively attached to longitudinal end portions (end portions on the near side in FIG. 2) of the imaging units 110Y, 110M, 110C, and 110K. Corresponding to these connector portions 196Y, 196M, 196C and 196K, connector portions 201Y, 201M, 201C and 201K are provided on the main body side (the connector portions 201Y, 201M, 201C and 201K are secured on the main body casing 101 of the image forming apparatus through an unshown frame).

Figure 3:
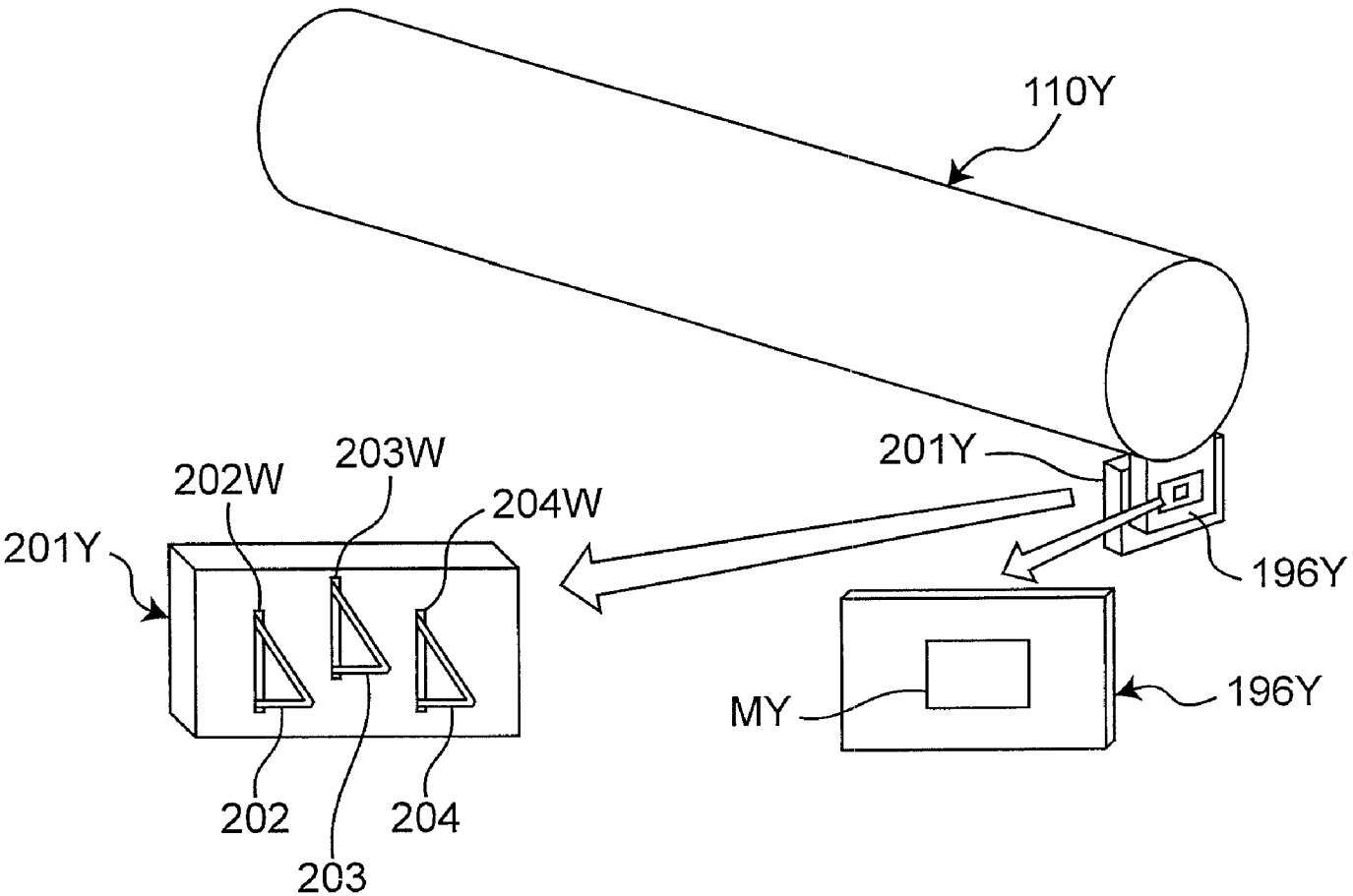
FIG. 3 is a view showing layout of an imaging unit in the case where contacts on the side of the main body of the image forming apparatus and contacts on the side of the imaging unit are in a connected state.
Figure 4:
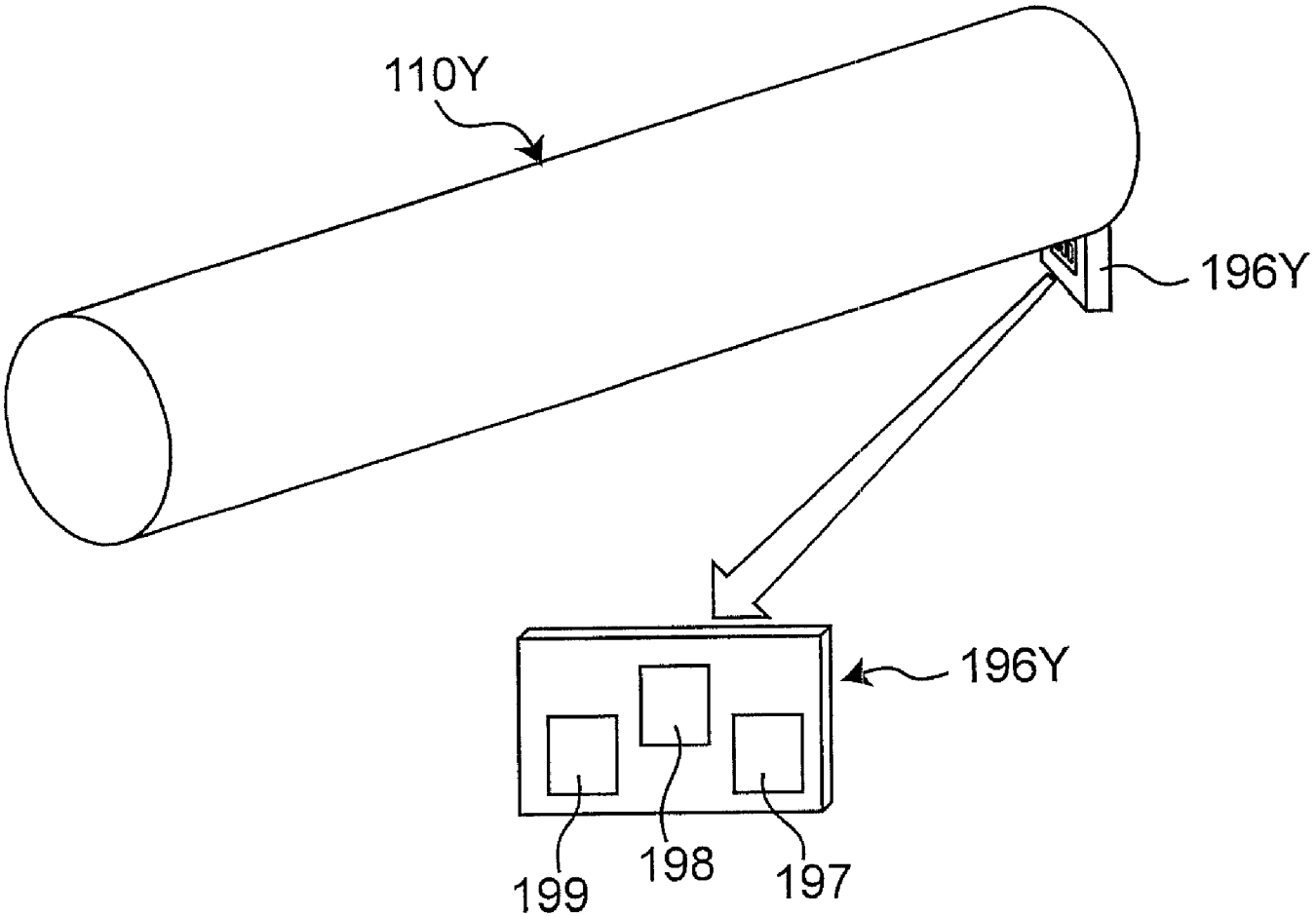
FIG. 4 is an enlarged view showing the contacts on the imaging unit side.

For example, as shown in the lower right portion of FIG. 3, a memory element MY and an unshown peripheral circuit are mounted on the outer surface of the connector portion 196Y of the imaging unit 110Y. As shown in FIG. 4, tin-plated contacts 197, 198 and 199 having a rectangular plate shape are provided on the inner surface of the connector portion 196Y. It is to be noted that other imaging units 110M, 110C and 110K are constituted in completely the same manner as the imaging unit 110Y.

As shown in the lower left part of FIG. 3, tin-plated contacts 202, 203 and 204 are respectively provided on the connector portion 201Y of the main body side at positions corresponding to the contacts 197, 198, and 199 of the imaging unit 110Y side. More specifically, the connector portion 201Y is formed into a generally rectangular parallelepiped box shape having slits 202*w*, 203*w* and 204*w* on the surface facing the connector portion 196Y of the imaging unit 110Y side. The contacts 202, 203 and 204 are structured by bending metal wires into a generally triangular shape. The root portions of the contacts 202, 203 and 204 are incorporated in the connector portion 201Y and fixed to the inside of the connector portion 201Y. While the top parts of the contacts 202, 203 and 204 project to the outside of the connector portion 201Y through the slits 202*w*, 203*w* and 204*w* in the natural state (state of FIG. 3), they retreat to the inside of the connector portion 201Y by their own elasticity when they come into contact with the contacts 197, 198 and 199 of the imaging unit 110Y side. This helps to absorb variation in the mounting position of the imaging unit 110Y mounted on the main body and to make the contacts 202, 203 and 204 of the main body side come into contact with the contacts 197, 198 and 199 of the imaging unit 110Y side with a certain pressure. It is to be noted that other connector portions 201M, 201C and 201K of the main body side are also constituted in completely the same way as the connector portion 201Y.

Figure 5:
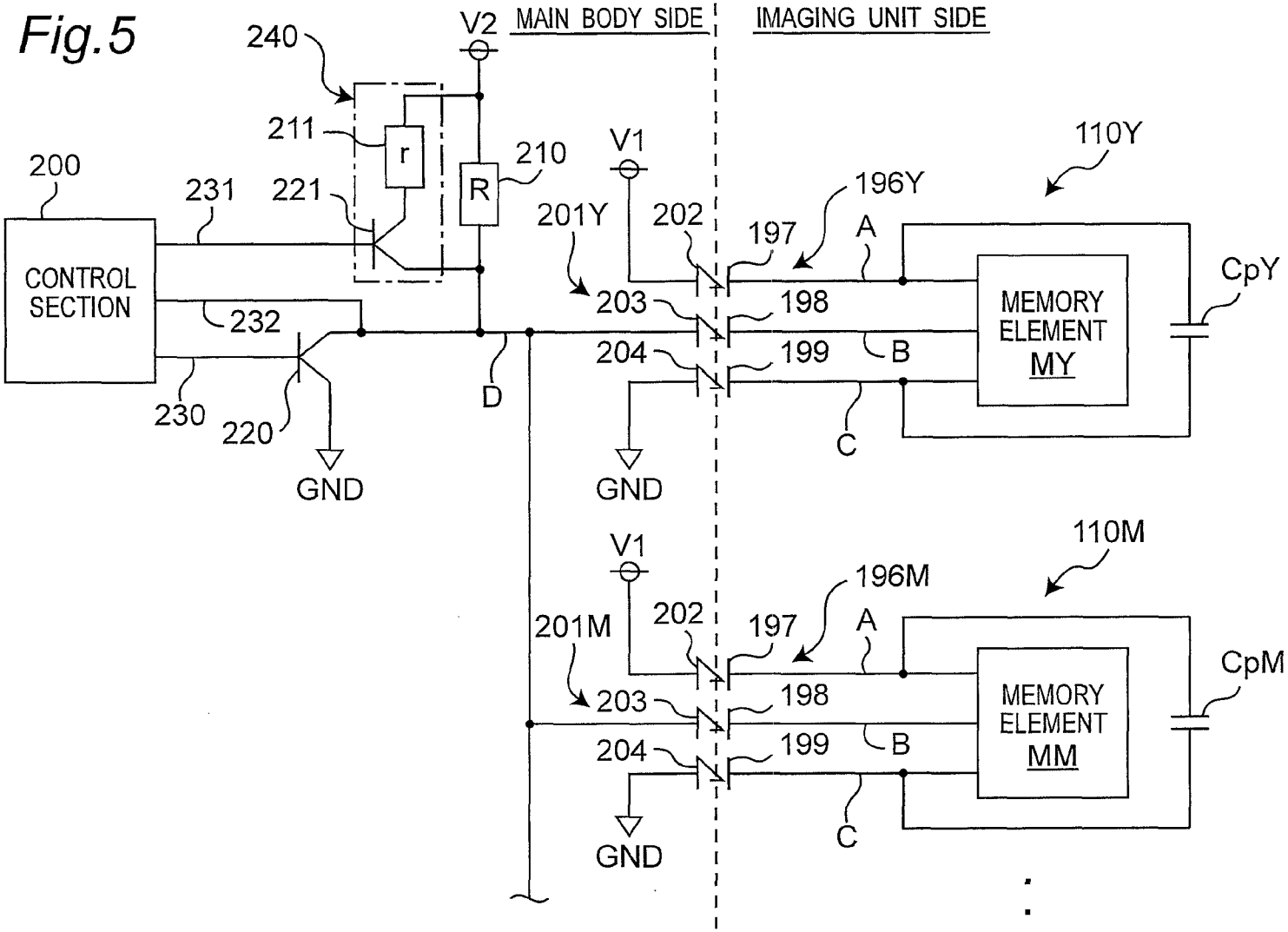
FIG. 5 is a view showing a circuit configuration of a communication system between the main body and imaging units in the case where the imaging units are mounted on the main body of the image forming apparatus.

FIG. 5 shows a circuit configuration of a communication system between the main body and the imaging units in the case where the imaging unit 110Y, 110M, . . . are mounted on the main body of the image forming apparatus 110. The left-hand side of FIG. 5 corresponds to a circuit configuration of the main body while the right-hand side of FIG. 5 corresponds to a circuit configuration of the imaging unit side. It should be understood that four imaging units 110Y, 110M, 110C and 110K are mounted in actuality though only two imaging units 110Y and 110M are shown in FIG. 5. Hereinbelow, explanation will mainly be given of the imaging unit 110Y.

On the imaging unit 110Y side, the memory element MY and the contacts 197, 198 and 199 are electrically connected via an interconnection A constituting a power source line, an interconnection B constituting a communication line, and an interconnection C constituting a ground line (hereinafter, the term "connection" refers to electric connection). A bypass capacitor CpY is connected to between the interconnection A and the interconnection C. The capacity of the bypass capacitor CpY is set at 0.1 μF in this example. For the imaging unit 110M, a memory element MM and a bypass capacitor CpM are shown in the drawing.

On the main body side, a power supply V1 and the contact 202 are connected, and a ground GND and the contact 204 are connected. A power supply V2 is connected to the contact 203 via a resistance (value of resistance R) 210 and an interconnection D. In this example, a switching circuit 240 is connected with the resistance 210 in parallel. The switching circuit 240 is made up of a resistance (value of resistance r) 211 and a transistor 221 in series connection. The transistor 221 is ON/OFF controlled at specified timing by switching signals from a control section 200 through an interconnection 231. In this example, the value of resistance R is set at several dozen kΩ, and the value of resistance r is set at several kΩ. It is to be noted that potentials of the power supply V1 and V2 may be identical or may be different from each other.

When the transistor 221 is in OFF state, impedance between the power supply V2 and the interconnection D is equal to the value of resistance R. In this state, a normal current which should be passed from the power supply V2 to the interconnection D side during normal operation (minimum current necessary for communication: about 0.1 mA to 0.5 mA in this example) can be supplied. When the transistor 221 is turned on, impedance between the power supply V2 and the interconnection D dramatically decrease to the level substantially equal to the value of resistance r as the value of resistance r is extremely smaller than the value of resistance R. In this state, a contact-corrosion preventing current larger than the normal current (maximum current that the imaging unit can withstand: about 1 mA to several mA in this example) can be supplied from the power supply V2 to the interconnection D side.

The interconnection D is connected to the ground GND via the transistor 220. The transistor 220 is ON/OFF controlled at specified timing by communication signals from the control section 200 through the interconnection 230. The interconnection D is also connected to an interconnection 232 for receiving communication signals from each of the memory elements to the control section 200.

In the above circuit configuration, when the imaging unit 110Y is mounted on the main body of the image forming apparatus 100, the contacts 202, 203 and 204 of the connector portion 201Y on the main body side and the contacts 197, 198 and 199 of the connector portion 196Y on the imaging unit 110Y side correspondingly come into contact with each other (it is assumed that before mounting, corrosion of the contacts of both the sides are not developed to a level of a complete non-contact state. Pairs of the contacts corresponding to each other are respectively referred to as a first contact (202, 197), a second contact (203, 198), and a third contact (204, 199)). Accordingly, electric power is supplied from the power supply V1 of the main body side to the memory element MY via the first contact (202, 197) and the interconnection A. The memory element MY is grounded via the interconnection C and the third contact (204, 199). It is to be noted that a current up to about several dozen mA is passed between the interconnection A and the interconnection C via the bypass capacitor CpY at the moment when the imaging unit 110Y is mounted.

Figure 6:
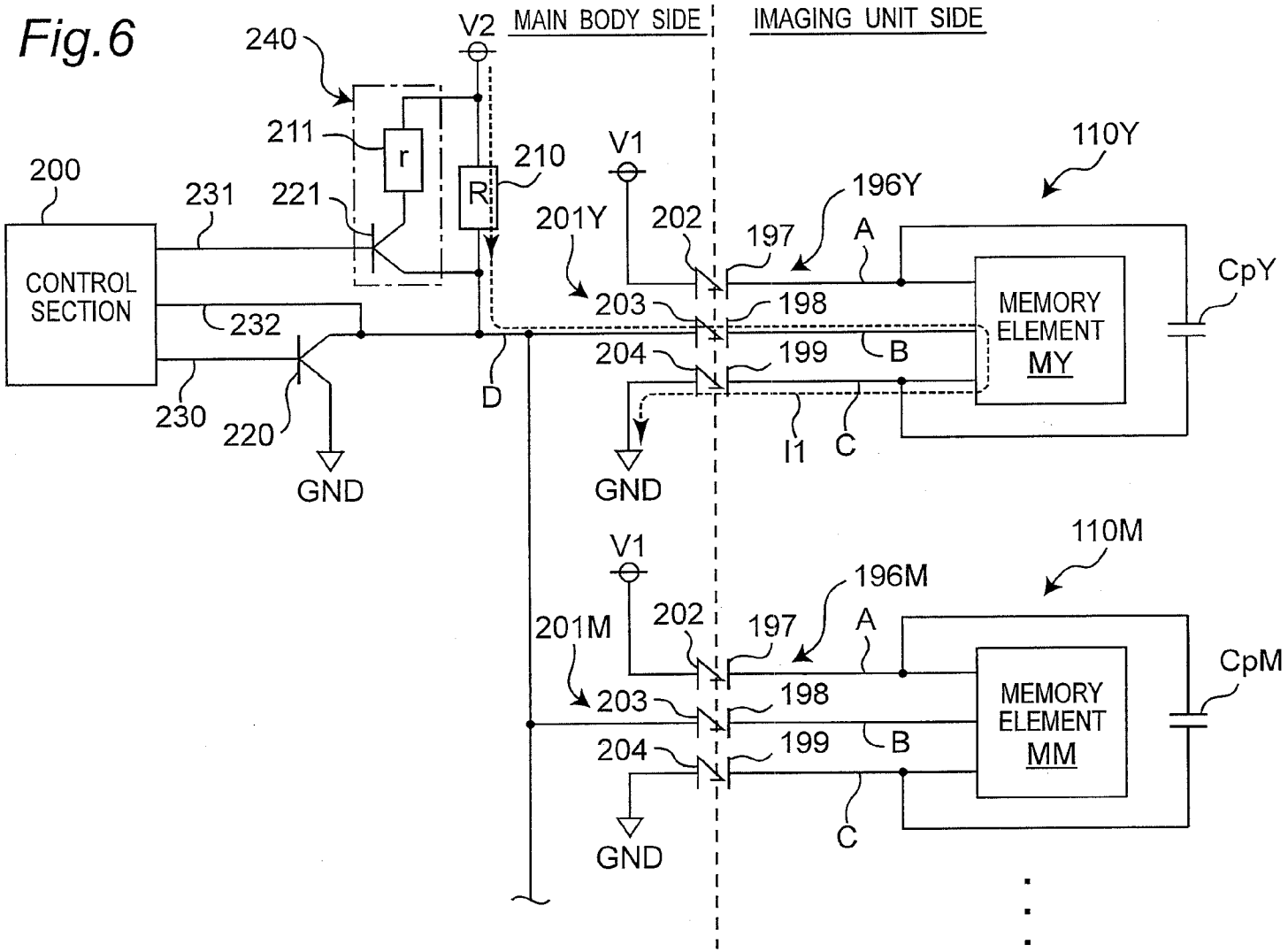
FIG. 6 is a view showing a normal current supply route from the main body to the imaging units in FIG. 5.

During normal operation, the transistor 221 is put in OFF state by a switching signal from the control section 200 through the interconnection 231. When the transistor 221 is in OFF state, the transistor 220 is ON/OFF controlled by communication signals from the control section 200 through the interconnection 230 (the transistor 220 alternately outputs a high level signal and a low level signal). Accordingly, as shown in FIG. 6, when the transistor 221 is in OFF state and data is transmitted from the memory element MY to the main body side, a normal current I1 is passed as a communication current from the power supply V2 to the memory element MY via the resistance 210, the interconnection D as a communication line, the second contact (203, 198) and the interconnection B (a current route is shown with a dashed line in FIG. 6). It is to be noted that the normal current I1 is further passed from the memory element MY to the ground GND of the main body side via the interconnection C and the third contact (204, 199).

Figure 7:
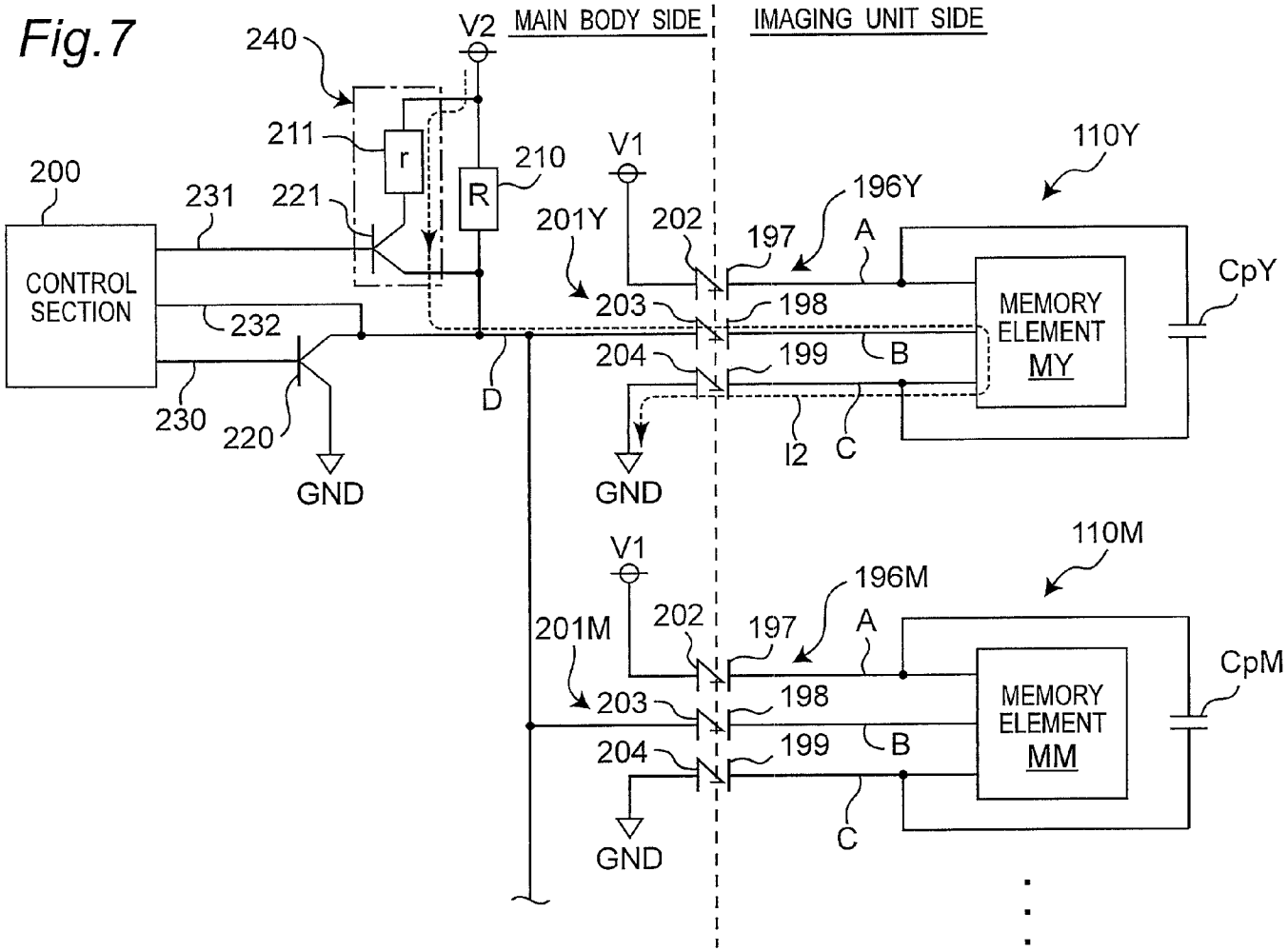
FIG. 7 is a view showing a contact-corrosion preventing current supply route from the main body to the imaging units in FIG. 5.

The transistor 221 is switched to ON state at specified timing by switching signals from the control section 200 through the interconnection 231. When the transistor 221 is in ON state, the transistor 220 is ON/OFF controlled by the communication signals from the control section 200 through the interconnection 230. Consequently, as shown in FIG. 7, a contact-corrosion preventing current is passed as a communication current from the power supply V2 to the memory element MY via the switching circuit 240, the interconnection D as a communication line, the second contact (203, 198) and the interconnection B (a current route is shown with a dashed line in FIG. 7). It is to be noted that the contact-corrosion preventing current I2 is further passed from the memory element MY to the ground GND of the main body side via the interconnection C and the third contact (204, 199) as with the normal current I1.

In this way, the contact-corrosion preventing current I2 is supplied from the main body to the imaging unit 110Y via the second contact (203, 198) at specified timing. As for the timing of current supply, one second supply per several days for example is considered to be sufficient for contact-corrosion prevention under environmental conditions such as normal temperature and humidity. Therefore, corrosion of the second contact (203, 198) between the main body and the imaging unit 110Y can effectively be prevented while avoiding unnecessary increase in power consumption. Thus, the reliability of electric connection between the main body and the imaging unit 110Y can be enhanced.

The control section 200 can be structured by using a component (CPU in this example) for supplying the normal current I1. The switching circuit 240 is structured by using the resistance 210 with the resistance 211 and the transistor 221 added thereto. Therefore, corrosion prevention of the second contact (203, 198) can be achieved with a low cost.

Further, the main body includes the switching circuit 240 and the control section 200, and therefore in the case where a plurality of (four) imaging units 110Y, 110M, 110C and 110K such as those in yellow, magenta, cyan and black are to be mounted on the main body as in this example, a pair of the switching circuit 240 and the control section 200 can supply the contact-corrosion preventing current I2 to each of a plurality of the imaging units 110Y, 110M, 110C and 110K. Therefore, corrosion prevention of the second contact (203, 198) can be achieved with a lower cost.

Figure 8:
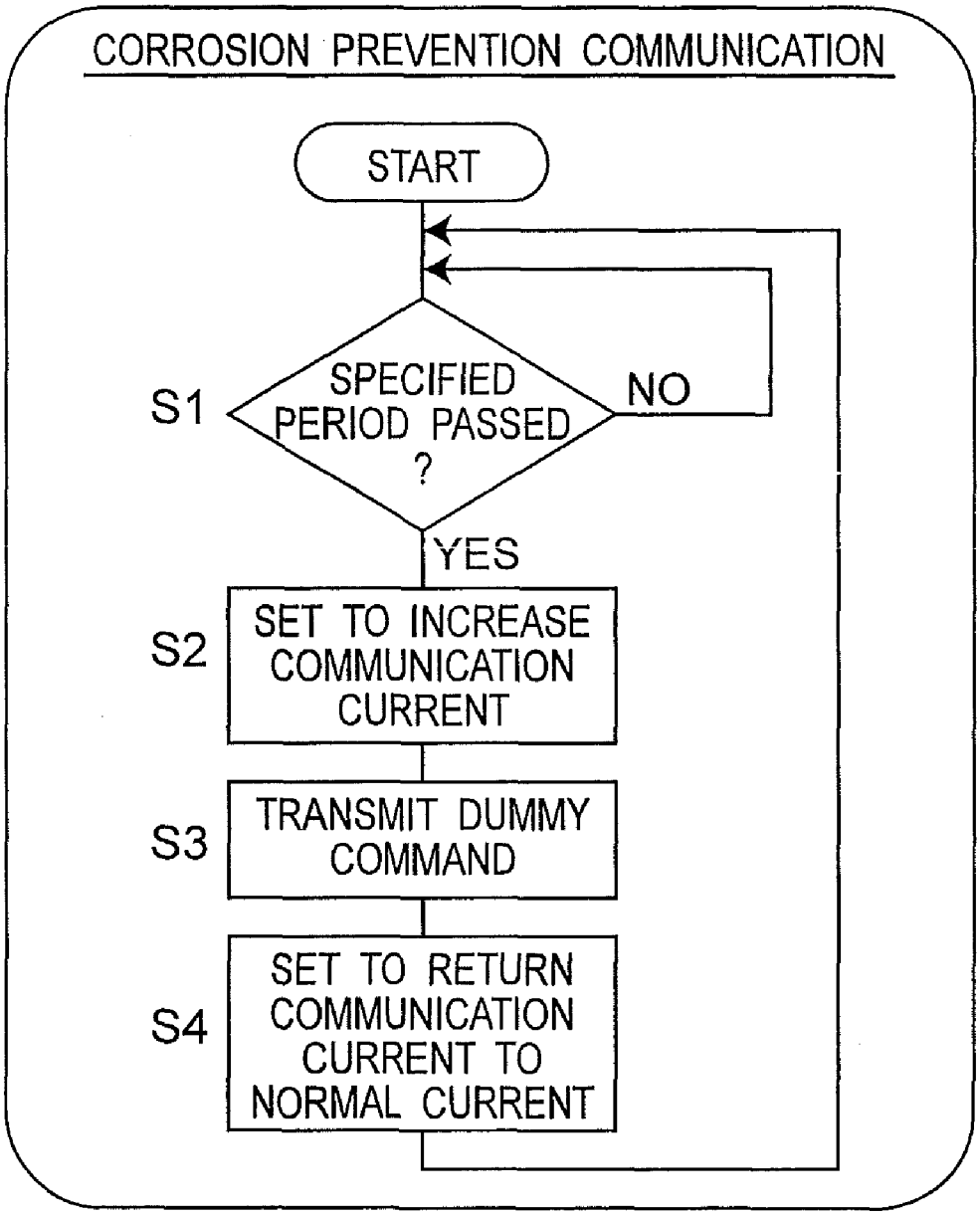
FIG. 8 is a view showing a control flow for supplying the contact-corrosion preventing current from the main body to the imaging unit for every specified periods.

FIG. 8 shows a control flow by the control section 200 for supplying the contact-corrosion preventing current I2 from the main body to the imaging unit 110Y for every specified period.

In this control flow, the procedure first waits for passage of a specified period after the start of operation (S1). After the passage of the specified period (YES at S1), the control section 200 switches the transistor 221 to ON state, and sets to increase the communication current to the contact-corrosion preventing current I2 (S2). Next, with a dummy command (meaningless command), the control section 200 performs ON/OFF control of the transistor 220 (see FIG. 5), for example for 1 second, and transmits the dummy command to the imaging unit 110Y (S3). Upon transmission of the dummy command, the contact-corrosion preventing current I2 (see FIG. 7) is passed as a communication current from the power supply V2 of the main body to the memory element MY via the switching circuit 240, the interconnection D as a communication line, the second contact (203, 198) and the interconnection B. Next, the control section 200 switches the transistor 221 (see FIG. 5) to OFF state, and sets to return the communication current to the normal current I1 (S4). Then, the processing of steps S1 to S4 is repeated.

If the control section 200 performs ON/OFF control of the transistor 220 to transmit a certain command to the imaging unit 110Y during repeated operation of step S1, the normal current I1 (see FIG. 6) is passed as a communication current from the power supply V2 of the main body to the memory element MY via the resistance 210, the interconnection D as a communication line, the second contact (203, 198) and the interconnection B.

According to this control flow, the contact-corrosion preventing current I2 can be supplied from the main body to the imaging unit 110Y via the second contact (203, 198) for every specified period. This makes the control by the control section 200 plain and simple.

The control flow of FIG. 8 may be applied not only to the imaging unit 110Y but also to other imaging units 110M, 110C and 110K in the same manner.

It is preferable that the above-mentioned specified periods i.e., a cycle of transmitting the dummy command to each of the imaging units, may be set appropriately depending on such elements as physical properties of the plating metal of the second contact (203, 198) and the material of the contact itself, the operating environment of the image forming apparatus, and frequency of communication with the imaging units.

Figure 9:
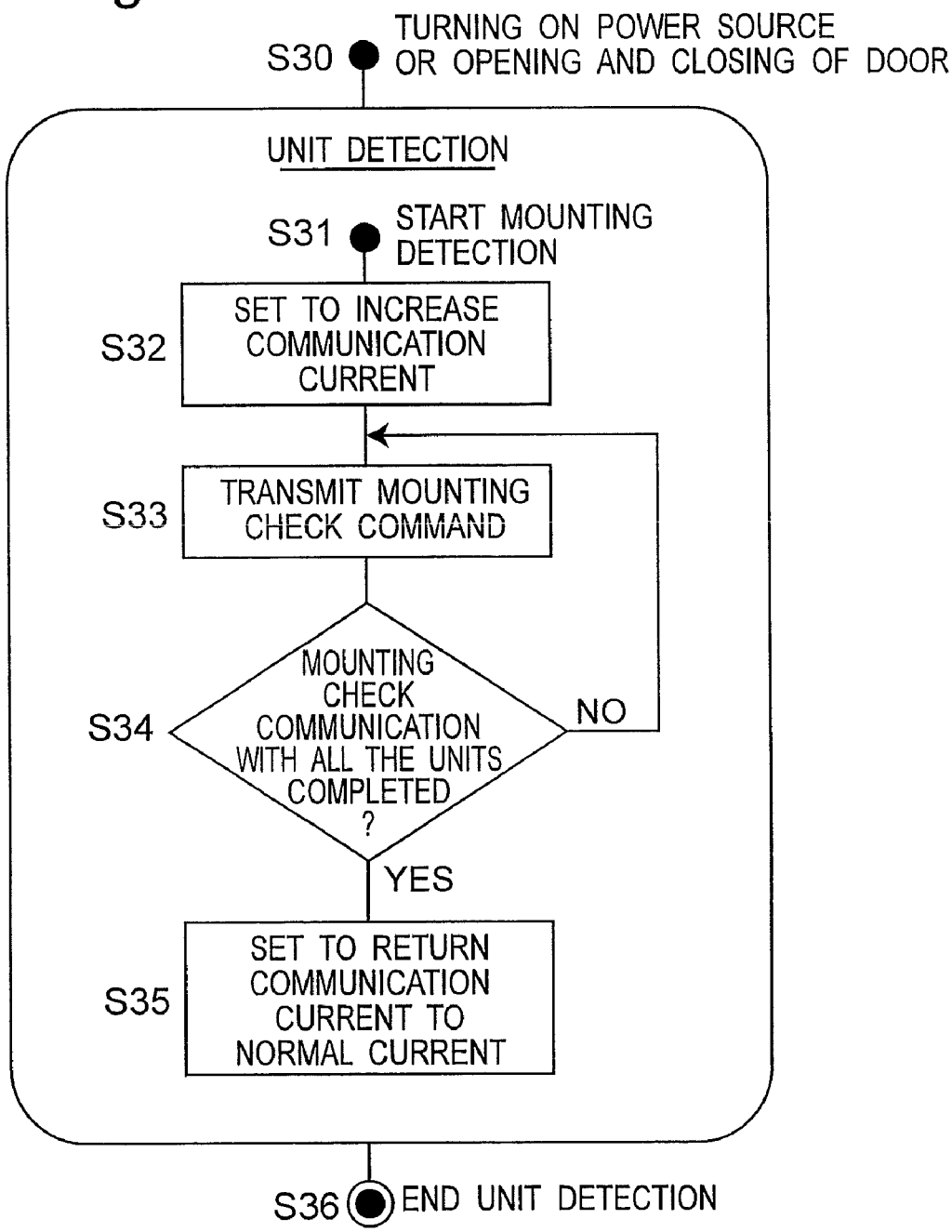
FIG. 9 is a view showing a control flow for supplying the contact-corrosion preventing current from the main body to the imaging unit at the time of mounting check communication relating to turning on a power source or opening and closing of a door of the image forming apparatus.

FIG. 9 shows a control flow by the control section 200 for supplying the contact-corrosion preventing current I2 from the main body to the imaging units 110Y, 110M, 110C and 110K at the time of mounting check communication relating to turning on the power source or opening and closing of a door of the image forming apparatus 100.

During the power OFF state of the image forming apparatus, an imaging unit may be detached from or attached to the main body. Accordingly, in general, the mounting check communication is performed between the main body and the imaging unit for checking whether or not the imaging unit is normally mounted in connection with turning on the power source of the image forming apparatus. Similarly, when the door of the image forming apparatus (used for attachment and detachment of an imaging unit) is opened and closed, an imaging unit may actually be detached from or attached to the main body. Accordingly, in general, the mounting check communication is performed between the main body and the imaging unit for checking whether or not the imaging unit is normally mounted in connection with opening and closing of the door. The control flow of FIG. 9 is to supply the contact-corrosion preventing current I2 from the main body to the imaging units 110Y, 110M, 110C and 110K using such a mounting check communication.

More specifically, upon turning on the power source or opening and closing of the door of the image forming apparatus (S30), the procedure proceeds to "unit detection" processing to start detection (mounting detection) of whether or not the imaging units 110Y, 110M, 110C and 110K are normally mounted (S31).

First, the control section 200 switches the transistor 221 (see FIG. 5) to ON state, and sets to increase the communication current to the contact-corrosion preventing current I2 (S32). Next, the control section 200 performs ON/OFF control of the transistor 220 (see FIG. 5) with a mounting check command and transmits the mounting check command to the imaging unit 110Y to perform mounting check communication with the imaging unit 110Y (S33). At the time of mounting check communication, the contact-corrosion preventing current I2 (see FIG. 7) is passed as a communication current from the power supply V2 of the main body to the memory element MY via the switching circuit 240, the interconnection D as a communication line, the second contact (203, 198) and the interconnection B. Once the mounting check communication with the imaging unit 110Y is completed, the control section 200 also performs the same mounting check communication with other imaging units 110M, 110C and 110K in sequence (S34). Once the mounting check communication is completed with respect to all the imaging units (YES at S34), the control section 200 switches the transistor 221 (see FIG. 5) to OFF state and sets to return the communication current to the normal current I1 (S35). This ends the "unit detection" processing (S36).

In this case, a natural oxidation film on the surface of the second contact (203, 198) between the main body and the imaging units 110Y, 110M, 110C and 110K can be destroyed after turning on the power source or mounting of the imaging unit and before execution of an actual print job by the image forming apparatus. Therefore, it becomes possible to prevent actual harm caused by corrosion of the second contact (203, 198).

It is to be noted that the timing of supplying the contact-corrosion preventing current I2 from the main body to the imaging units 110Y, 110M, 110C and 110K is not limited to the time of mounting check communication relating to turning on the power source or opening and closing of the door. For example, in the latest general image forming apparatuses, when user operation is not performed for a certain period, the apparatuses are controlled so that their operating mode is shifted to a sleep state (which widely includes the state where operation of a part of elements is stopped) in order to achieve energy saving. Therefore, the contact-corrosion preventing current I2 may be supplied from the main body to the imaging units 110Y, 110M, 110C and 110K at the time of returning from such a sleep state for example.

Figure 10:
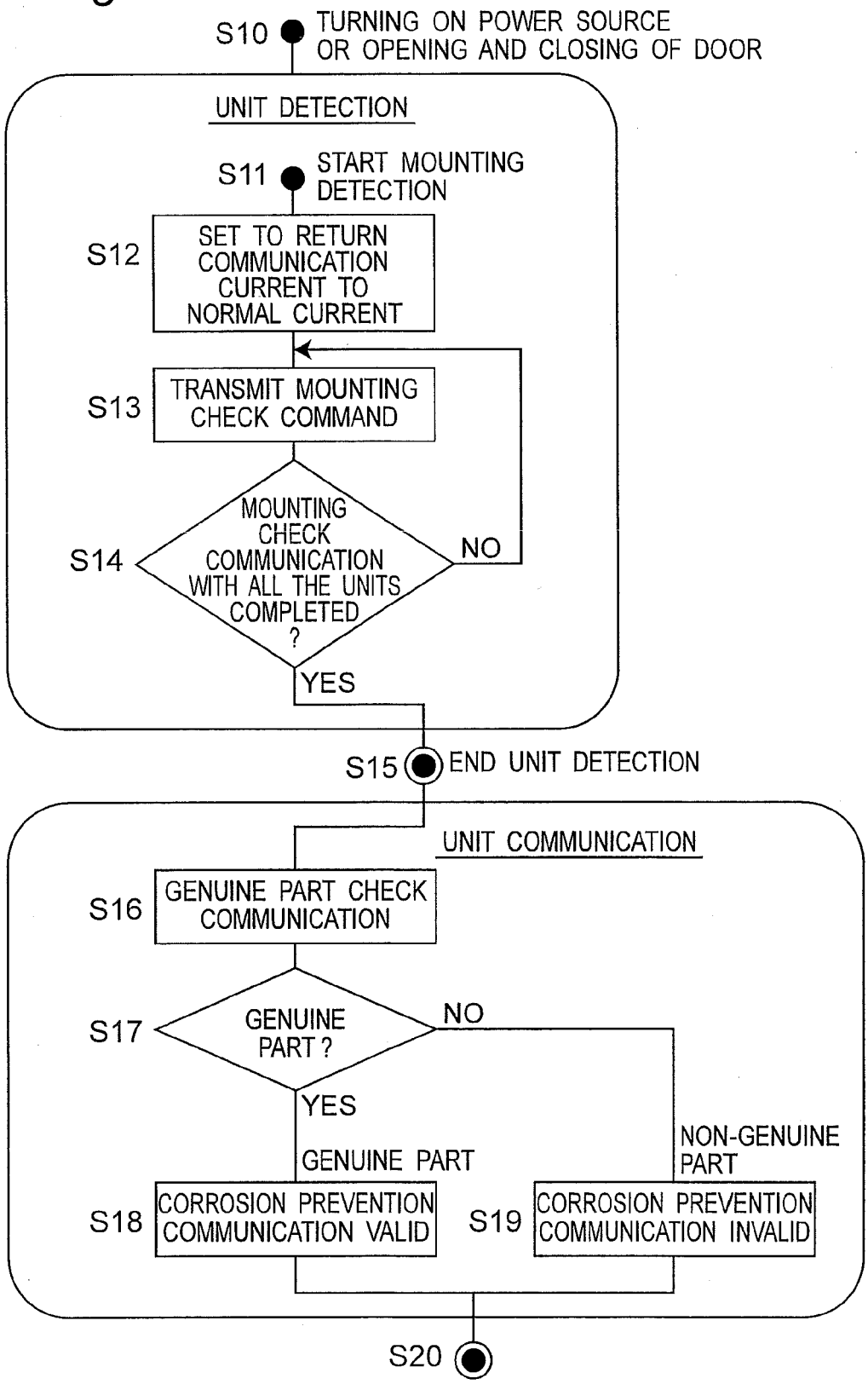
FIG. 10 is a view showing a control flow for permitting supply of the contact-corrosion preventing current to the imaging unit only when an imaging unit mounted on the main body is a genuine part.

FIG. 10 shows a control flow for permitting supply of the contact-corrosion preventing current I2 to the imaging units 110Y, 110M, 110C and 110K only if the imaging units 110Y, 110M, 110C and 110K mounted on the main body are genuine parts.

If the imaging units 110Y, 110M, 110C and 110K mounted on the main body of the image forming apparatus are non-genuine parts, it is unclear whether or not the imaging units can withstand the contact-corrosion preventing current I2. The control flow of FIG. 10 is to forbid supply of the contact-corrosion preventing current I2 if the imaging units 110Y, 110M, 110C and 110K mounted on the main body are non-genuine parts to avoid the situation where the imaging units are destroyed by the contact-corrosion preventing current.

More specifically, upon turning on the power source of the image forming apparatus or opening and closing of the door for use in attachment and detachment of the imaging units 110Y, 110M, 110C and 110K (S10), the procedure proceeds to "unit detection" processing to start detection (mounting detection) of whether or not the imaging units 110Y, 110M, 110C and 110K are normally mounted (S11).

In this case, the control section 200 first switches the transistor 221 (see FIG. 5) to OFF state, and sets the communication current to the normal current I1 (S12). Next, the control section 200 performs ON/OFF control of the transistor 220 (see FIG. 5) with a mounting check command and transmits the mounting check command to the imaging unit 110Y to perform mounting check communication with the imaging unit 110Y (S13). At the time of mounting check communication, the normal current I1 (see FIG. 6) is passed as a communication current from the power supply V2 of the main body to the memory element MY via the resistance 210, the interconnection D as a communication line, the second contact (203, 198) and the interconnection B. Once the mounting check communication with the imaging unit 110Y is completed, the control section 200 also performs the same mounting check communication with other imaging units 110M, 110C and 110K in sequence (S14). Once the mounting check communication is completed for all the imaging units (YES at S14), the control section 200 ends "unit detection" processing (S15).

Following the "unit detection" processing, the control section 200 functions as a genuine part detection section, and the procedure proceeds to "unit communication" processing to perform genuine part check communication with the imaging units 110Y, 110M, 110C and 110K (S16). More specifically, the transistor 220 (see FIG. 5) is first ON/OFF controlled with a genuine part check command, and the genuine part check command is transmitted to the imaging unit 110Y to detect whether or not the imaging unit 110Y is a genuine part (genuine part check communication). At the time of the genuine part check communication, the normal current I1 (see FIG. 6) is passed as a communication current from the power supply V2 of the main body to the memory element MY via the resistance 210, the interconnection D as a communication line, the second contact (203, 198) and the interconnection B. Once the genuine part check communication with the imaging unit 110Y is completed, the control section 200 also performs the same genuine part check communication with other imaging units 110M, 110C and 110K in sequence. Next, the control section 200 sets a "corrosion prevention communication valid" flag if all the mounted imaging units 110Y, 110M, 110C and 110K are genuine parts (YES at S17) (S18), while if at least one non-genuine parts are included in the mounted imaging units 110Y, 110M, 110C and 110K (NO at S17), a "corrosion prevention communication invalid" flag is set (S19). These "corrosion prevention communication valid" flag and "corrosion prevention communication invalid" flag are maintained until next turning on of the power source or next opening and closing of the door of the image forming apparatus.

In this regard, in the case where communication with the imaging units 110Y, 110M, 110C and 110K is performed, the control section 200 puts the transistor 221 (see FIG. 5) in ON state and permits supply of the contact-corrosion preventing current I2 if the "corrosion prevention communication valid" flag is set, whereas if the "corrosion prevention communication invalid" flag is set, the control section 200 puts the transistor 221 (see FIG. 5) in OFF state and forbids supply of the contact-corrosion preventing current I2.

Accordingly, if all the imaging units 110Y, 110M, 110C and 110K mounted on the main body are genuine parts, the contact-corrosion preventing current I2 is supplied from the main body to each of the imaging units at specified timing, so that corrosion of the second contact (203, 198) can effectively be prevented. If at least one non-genuine part is included in the imaging units 110Y, 110M, 110C and 110K mounted on the main body, supply of the contact-corrosion preventing current I2 is forbidden, so that the situation where the imaging unit of the non-genuine part is destroyed by the contact-corrosion preventing current I2 can be prevented.

It is to be noted that in the above control flow, the control section 200 functioned as a genuine part detection section to execute the genuine part check communication with the imaging units so as to detect whether or not each of the imaging units was a genuine part. However, the genuine part detection section is not limited thereto and can be embodied in various ways.

Moreover in the above control flow, if at least one non-genuine part was included in the mounted imaging units 110Y, 110M, 110C and 110K, the "corrosion prevention communication invalid" flag was controlled to be set to uniformly forbid supply of the contact-corrosion preventing current I2, but the invention is not limited to this configuration. For example, a "corrosion prevention communication valid" flag or a "corrosion prevention communication invalid" flag may be set for the respective imaging units 110Y, 110M, 110C and 110K depending on whether or not each of the imaging units is a genuine part. In the case where communication with a certain imaging unit is performed, the control section 200 may permit supply of the contact-corrosion preventing current I2 if the "corrosion prevention communication valid" flag is set for the pertinent imaging unit, whereas if the "corrosion prevention communication invalid" flag is set for the pertinent imaging unit, the control section 200 may forbid supply of the contact-corrosion preventing current I2. Thus, supply/non-supply of the contact-corrosion preventing current I2 may be switched for the respective imaging units 110Y, 110M, 110C and 110K.

In the embodiment, although the contacts 202, 203 and 204 of the main body side and the contacts 197, 198 and 199 of the imaging unit side are tin plated, it should be understood that the invention is not limited to this configuration. The invention may also be applied to the case where the contacts of both the sides are not plated. The invention may also be applied to the case where the contacts of one side are gold plated and the contacts of the other side are not plated or plated with other metals other than gold.

In the embodiment, explanation was given of the case where four imaging units were provided, though it should naturally be understood that the invention is not limited to this configuration. The invention may be applied to the case where the number of imaging units is other than four (one, two, three, five or more units).

As is described above, an image forming apparatus according to the present invention comprises:

a main body; and at least one imaging unit detachably mounted on the main body for performing electrophotographic process, wherein when the imaging unit is mounted on the main body, the main body and the imaging unit are electrically connected via contacts of each other, and wherein the main body comprises:

a switching circuit for switching between a normal current which should be applied at a time of normal operation and a contact-corrosion preventing current which is set larger than the normal current, each of the currents being to be applied to the imaging unit through the contacts; and a control section for controlling the switching circuit to temporarily switch from the normal current to the contact-corrosion preventing current at specified timing.

In the image forming apparatus of the invention, the contact-corrosion preventing current is temporarily supplied from the main body to the imaging units via the contacts at specified timing. As for the timing of current supply, one second supply per several days for example is considered to be sufficient for contact-corrosion prevention under environmental conditions such as normal temperature and humidity. Therefore, corrosion of the contacts between the main body and the imaging units can effectively be prevented while avoiding unnecessary increase in power consumption. Thus, the reliability of electric connection between the main body and the imaging units can be enhanced. The switching circuit and the control section can be constituted by using the component for supplying the normal current. Consequently, corrosion prevention of the contacts can be achieved with a low cost. Further, the main body includes the switching circuit and the control section, and therefore in the case where a plurality of imaging units such as those in yellow, magenta, cyan and black are to be mounted on the main body, a pair of the switching circuit and the control section can supply the contact-corrosion preventing current to each of a plurality of the imaging units. This makes it possible to achieve corrosion prevention of the contacts with a lower cost.

In the image forming apparatus of one embodiment, the control section controls the switching circuit so as to supply the contact-corrosion preventing current to the imaging unit for every specified period.

In the image forming apparatus of this one embodiment, the contact-corrosion preventing current is supplied from the main body to the imaging units for every specified period, so that control by the control section becomes plain and simple.

In the image forming apparatus of one embodiment, the control section controls the switching circuit so as to supply the contact-corrosion preventing current to the imaging unit at a time of mounting check communication relating to turning on a power source of the image forming apparatus.

During the power OFF state of the image forming apparatus, an imaging unit may be detached from or attached to the main body. Accordingly, in general, the mounting check communication is performed between the main body and the imaging unit for checking whether or not the imaging unit is normally mounted in connection with turning on of the power source of the image forming apparatus. In this regard, in the image forming apparatus of this one embodiment, the contact-corrosion preventing current is supplied from the main body to the imaging units at the time of mounting check communication relating to the turning on of the power source of the image forming apparatus. Accordingly, a natural oxidation film on the surface of the contacts between the main body and the imaging units can be destroyed after turning on of the power source and before execution of an actual print job by the image forming apparatus. Therefore, it becomes possible to prevent actual harm caused by corrosion of the contacts.

In the image forming apparatus of one embodiment, the control section controls the switching circuit so as to supply the contact-corrosion preventing current to the imaging unit at a time of mounting check communication relating to opening and closing of a door of the image forming apparatus.

When the door of the image forming apparatus is opened and closed, an imaging unit may actually be detached from or attached to the main body (for such purposes as replacement). Accordingly, in general, the mounting check communication is performed between the main body and the imaging unit for checking whether or not the imaging unit is normally mounted in connection with opening and closing of the door. In this regard, in the image forming apparatus of this one embodiment, the contact-corrosion preventing current is supplied from the main body to the imaging units at the time of mounting check communication relating to opening and closing of the door of the image forming apparatus. As a consequence, a natural oxidation film on the surface of the contacts between the main body and the imaging units can be destroyed after mounting of the imaging units and before execution of an actual print job by the image forming apparatus. Therefore, it becomes possible to prevent actual harm caused by corrosion of the contacts.

The image forming apparatus of one embodiment further comprises:

a genuine part detection section for detecting, when an imaging unit is mounted on the main body, whether or not the imaging unit is a genuine part based on the imaging unit, wherein the control section performs control so as to permit supply of the contact-corrosion preventing current if the imaging unit is a genuine part, and to forbid supply of the contact-corrosion preventing current if the imaging unit is a non-genuine part.

If the imaging unit mounted on the main body of the image forming apparatus is a non-genuine part, it is unclear whether or not the imaging unit can withstand the contact-corrosion preventing current (which is set larger than the normal current). Accordingly, in the image forming apparatus of this one embodiment, when an imaging unit is mounted on the main body, the genuine part detection section detects based on the imaging unit whether or not the imaging unit is a genuine part. The control section performs control so as to permit supply of the contact-corrosion preventing current if the imaging unit is a genuine part, and to forbid supply of the contact-corrosion preventing current if the imaging unit is a non-genuine part. Therefore, if the imaging unit mounted on the main body is a genuine part, the contact-corrosion preventing current is supplied from the main body to the imaging unit at specified timing, so that corrosion of the contacts can effectively be prevented. If the imaging unit mounted on the main body is a non-genuine part, supply of the contact-corrosion preventing current is forbidden, so that the situation where the imaging unit is destroyed by the contact-corrosion preventing current can be avoided.

In the image forming apparatus of one embodiment, the genuine part detection section detects whether or not an imaging unit is a genuine part by transmitting to the imaging unit a genuine part check command to detect whether or not the imaging unit is a genuine part.

A contact-corrosion prevention method performed by an image forming apparatus according to the present invention, comprises:

a step for electrically connecting a main body and an imaging unit via contacts of each other when the imaging unit for performing electrophotographic process is detachably mounted on the main body;

a step for applying a normal current to the imaging unit through the contacts at a time of normal operation;

a step for controlling a switching circuit so as to temporarily switch from the normal current to a contact-corrosion preventing current set larger than the normal current at predetermined timing; and a step for applying the contact-corrosion preventing current to the imaging unit when the switching circuit is switched.

In the contact-corrosion prevention method performed by an image forming apparatus of one embodiment, in the step for controlling the switching circuit, switchover from the normal current to the contact-corrosion preventing current is performed for every specified period.

The contact-corrosion prevention method performed by an image forming apparatus of one embodiment, further comprises:

a step for performing mounting check communication relating to turning on a power source of the image forming apparatus, wherein in the step for controlling the switching circuit, switchover from the normal current to the contact-corrosion preventing current is performed at a time of the mounting check communication.

The contact-corrosion prevention method performed by an image forming apparatus of one embodiment, further comprises:

a step for performing mounting check communication relating to opening and closing of a door of the image forming apparatus, wherein in the step for controlling the switching circuit, switchover from the normal current to the contact-corrosion preventing current is performed at a time of the mounting check communication.

The contact-corrosion prevention method performed by an image forming apparatus of one embodiment, further comprises:

a step for detecting, when an imaging unit is mounted on the main body, whether or not the imaging unit is a genuine part based on the imaging unit; and a step for performing control so as to permit supply of the contact-corrosion preventing current if the imaging unit is a genuine part, and to forbid supply of the contact-corrosion preventing current if the imaging unit is a non-genuine part.

In the contact-corrosion prevention method performed by an image forming apparatus of one embodiment, in the step for detecting whether or not the imaging unit is a genuine part, a genuine part check command is transmitted to the imaging unit to detect whether or not the imaging unit is a genuine part.

As is clear from the above, according to the image forming apparatus of the invention and the contact-corrosion prevention method performed by the same, the reliability of electric connection between the main body and the imaging units can be enhanced.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. An image forming apparatus, comprising:

a main body; and at least one imaging unit detachably mounted on the main body for performing electrophotographic process, wherein when the imaging unit is mounted on the main body, the main body and the imaging unit are electrically connected via contacts of each other, and wherein the main body comprises:

a switching circuit for switching between a normal current which should be applied at a time of normal operation and a contact-corrosion preventing current which is set larger than the normal current, each of the currents being to be applied to the imaging unit through the contacts; and a control section for controlling the switching circuit to temporarily switch from the normal current to the contact-corrosion preventing current at specified timing.

2. The image forming apparatus as claimed in claim 1, wherein the control section controls the switching circuit so as to supply the contact-corrosion preventing current to the imaging unit for every specified period.

3. The image forming apparatus as claimed in claim 1, wherein the control section controls the switching circuit so as to supply the contact-corrosion preventing current to the imaging unit at a time of mounting check communication relating to turning on a power source of the image forming apparatus.

4. The image forming apparatus as claimed in claim 1, wherein the control section controls the switching circuit so as to supply the contact-corrosion preventing current to the imaging unit at a time of mounting check communication relating to opening and closing of a door of the image forming apparatus.

5. The image forming apparatus as claimed in claim 1, further comprising:

a genuine part detection section for detecting, when an imaging unit is mounted on the main body, whether or not the imaging unit is a genuine part based on the imaging unit, wherein the control section performs control so as to permit supply of the contact-corrosion preventing current if the imaging unit is a genuine part, and to forbid supply of the contact-corrosion preventing current if the imaging unit is a non-genuine part.

6. The image forming apparatus as claimed in claim 5, wherein the genuine part detection section detects whether or not an imaging unit is a genuine part by transmitting to the imaging unit a genuine part check command to detect whether or not the imaging unit is a genuine part.

7. A contact-corrosion prevention method performed by an image forming apparatus, comprising:

a step for electrically connecting a main body and an imaging unit via contacts of each other when the imaging unit for performing electrophotographic process is detachably mounted on the main body;

a step for passing a normal current to the imaging unit through the contacts at a time of normal operation;

a step for controlling a switching circuit so as to temporarily switch from the normal current to a contact-corrosion preventing current set larger than the normal current at predetermined timing; and a step for passing the contact-corrosion preventing current to the imaging unit when the switching circuit is switched.

8. The contact-corrosion prevention method performed by the image forming apparatus as claimed in claim 7, wherein in the step for controlling the switching circuit, switchover from the normal current to the contact-corrosion preventing current is performed for every specified period.

9. The contact-corrosion prevention method performed by the image forming apparatus as claimed in claim 7, further comprising:

a step for performing mounting check communication relating to turning on a power source of the image forming apparatus, wherein in the step for controlling the switching circuit, switchover from the normal current to the contact-corrosion preventing current is performed at a time of the mounting check communication.

10. The contact-corrosion prevention method performed by the image forming apparatus as claimed in claim 7, further comprising:

a step for performing mounting check communication relating to opening and closing of a door of the image forming apparatus, wherein in the step for controlling the switching circuit, switchover from the normal current to the contact-corrosion preventing current is performed at a time of the mounting check communication.

11. The contact-corrosion prevention method performed by the image forming apparatus as claimed in claim 7, further comprising:

a step for detecting, when an imaging unit is mounted on the main body, whether or not the imaging unit is a genuine part based on the imaging unit; and a step for performing control so as to permit supply of the contact-corrosion preventing current if the imaging unit is a genuine part, and to forbid supply of the contact-corrosion preventing current if the imaging unit is a non-genuine part.

12. The contact-corrosion prevention method performed by the image forming apparatus as claimed in claim 11, wherein in the step for detecting whether or not the imaging unit is a genuine part, a genuine part check command is transmitted to the imaging unit to detect whether or not the imaging unit is a genuine part.

* * * * *